US011674273B2

(12) United States Patent
Hutar et al.

(10) Patent No.: US 11,674,273 B2
(45) Date of Patent: Jun. 13, 2023

(54) MILLING DRUM WITH ALIGNMENT INTERFACE

(71) Applicant: Caterpillar Paving Products Inc., Brooklyn Park, MN (US)

(72) Inventors: Ryan Hutar, Plymouth, MN (US); Craig T. Hedstrom, Mounds View, MN (US); Nicholas B. Johnson, Dayton, MN (US); Eric S. Engelmann, Delano, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/495,232

(22) Filed: Oct. 6, 2021

(65) Prior Publication Data

US 2023/0105821 A1 Apr. 6, 2023

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 6,877,818 | B1 | 4/2005 | Gaertner et al. | |
| 7,144,192 | B2 | 12/2006 | Holl et al. | |
| 7,901,011 | B2 * | 3/2011 | Holl | E01C 23/088 299/39.4 |
| 8,474,919 | B2 | 7/2013 | Cipriani et al. | |
| 9,234,320 | B2 * | 1/2016 | Abresch | E01C 23/127 |
| 2020/0407927 | A1 | 12/2020 | Berning et al. | |
| 2021/0017721 | A1 | 1/2021 | Mannebach et al. | |

FOREIGN PATENT DOCUMENTS

| | | |
|---|---|---|
| CN | 201620345 | 11/2010 |
| DE | 202007002403 | 4/2007 |

* cited by examiner

*Primary Examiner* — Janine M Kreck

(57) ABSTRACT

A milling rotor of a milling machine can include a drum, cutting teeth, and a centering ring. The drum can extend along a longitudinal axis and can define an inner surface and an opposing outer surface. The drum can be securable to a drive assembly of the milling machine to allow the drum to rotate therewith. The cutting teeth can be connected to the outer surface of the drum and can be configured to engage pavement. The centering ring can be connected to the inner surface of the drum and can include a centering interface and an alignment interface. The centering interface can extend radially inward and can be engageable with a centering flange of the drive assembly to center the milling rotor with respect to the drive assembly. The alignment interface can be adjacent the centering interface and can extend radially inward of the centering interface.

13 Claims, 6 Drawing Sheets

MILLING DRUM WITH ALIGNMENT INTERFACE

TECHNICAL FIELD

This disclosure relates generally, but not by way of limitation, to milling equipment. More particularly, this disclosure relates to milling rotors or drums for cold planers.

BACKGROUND

Cold planers are used for milling of pavement and other surfaces, such as prior to resurfacing or repaving of a road. Cold planers include a rotating drum or rotor that includes a plurality of teeth that rotate with the drum to engage the existing pavement to mill and remove a portion of the pavement, such as for reclamation of asphalt. Milling drums can be supported in a milling chamber of a planer or other milling machine, such as at both ends. In some cases, a support structure of the rotor can be engaged by a support flange of a driving assembly, as discussed in Holl et. al, U.S. Pat. No. 7,901,011.

SUMMARY OF THE INVENTION

To summarize at least a portion of the disclosure, a non-limiting list of examples is provided here:

Example 1 is a milling assembly of a work machine, the assembly comprising: a drive assembly connected to a body of the work machine and drivable to rotate about a longitudinal axis by a motor of the work machine, the drive assembly including a centering flange on an outer surface thereof; and a milling rotor releasably securable to the drive assembly, the milling rotor comprising: a drum extending along the longitudinal axis, the drum defining an inner surface and an opposing outer surface, the drum securable to the drive assembly to allow the drum to rotate therewith; a plurality of cutting teeth connected to the outer surface of the drum and configured to engage pavement; and a centering ring connected to the inner surface of the drum, the centering ring comprising: a centering interface facing radially inward and engageable with the centering flange to center the milling rotor with respect to the drive assembly; and an alignment interface adjacent the centering interface and extending radially inward of the centering interface, the alignment interface engageable with the drive assembly to limit contact between the centering interface and the drive assembly during installation thereof.

In Example 2, the subject matter of Example 1 optionally includes wherein a first longitudinal end of the drum is releasably securable to the drive assembly.

In Example 3, the subject matter of Example 2 optionally includes wherein the centering ring is located near a second longitudinal end of the drum, opposite the first longitudinal end.

In Example 4, the subject matter of any one or more of Examples 1-3 optionally include wherein the drive assembly includes a tube extending along the longitudinal axis, the centering flange connected to the tube, and the alignment interface engageable with the tube during installation of the rotor.

In Example 5, the subject matter of Example 4 optionally includes wherein the alignment interface is radially spaced away from the centering tube when the centering interface is engaged with the centering flange.

In Example 6, the subject matter of Example 5 optionally includes wherein the centering interface includes a plurality of centering bores engageable with a plurality of centering faces of the centering flange.

In Example 7, the subject matter of Example 6 optionally includes wherein the plurality of centering bores includes five bores.

In Example 8, the subject matter of any one or more of Examples 6-7 optionally include wherein the alignment interface includes a first chamfer connecting the alignment interface to the plurality of centering bores and a second chamfer extending to an end of the centering ring.

In Example 9, the subject matter of any one or more of Examples 6-8 optionally include wherein the alignment interface is releasably securable to the centering interface.

Example 10 is a milling rotor of a milling machine, the milling rotor comprising: a drum extending along a longitudinal axis and defining an inner surface and an opposing outer surface, the drum securable to a drive assembly of the milling machine to allow the drum to rotate therewith; a plurality of cutting teeth connected to the outer surface of the drum and configured to engage pavement; and a centering ring connected to the inner surface of the drum, the centering ring comprising: a centering interface extending radially inward from the inner surface and engageable with a centering flange of the drive assembly to center the milling rotor with respect to the drive assembly; and an alignment interface adjacent the centering interface and extending from the inner surface radially inward of the centering interface, the alignment interface engageable with the drive assembly to limit contact between the centering interface and the drive assembly during installation thereof.

In Example 11, the subject matter of Example 10 optionally includes wherein a first longitudinal end of the drum is releasably securable to the drive assembly.

In Example 12, the subject matter of Example 11 optionally includes wherein the centering ring is located near a second longitudinal end of the drum, opposite the first longitudinal end.

In Example 13, the subject matter of any one or more of Examples 10-12 optionally include wherein the drive assembly includes a tube extending along the longitudinal axis, the centering flange connected to the tube, and the alignment interface engageable with the tube during installation of the rotor.

In Example 14, the subject matter of Example 13 optionally includes wherein the alignment interface is radially spaced away from the centering tube when the centering interface is engaged with the centering flange.

In Example 15, the subject matter of Example 14 optionally includes wherein the centering interface includes a plurality of centering bores engageable with a plurality of centering faces of the centering flange.

In Example 16, the subject matter of Example 15 optionally includes wherein the plurality of centering bores includes five bores.

In Example 17, the subject matter of any one or more of Examples 15-16 optionally include wherein the alignment interface includes a first chamfer connecting the alignment interface to the plurality of centering bores and a second chamfer extending to an end of the centering ring.

In Example 18, the subject matter of any one or more of Examples 15-17 optionally include wherein the alignment interface is releasably securable to the centering interface.

Example 19 is a milling rotor for a cold planer, the milling rotor comprising: a drum extending along a longitudinal axis and defining an inner surface and an opposing outer surface engageable with pavement, the drum securable to a gearbox of the cold planer to allow the drum to rotate therewith; and a centering ring connected to the inner surface of the drum, the centering ring comprising: a wedge extending radially inward from the inner surface, the wedge engageable with a centering flange of the gearbox to center the milling rotor with respect to the gearbox; and a shoulder connected to and adjacent the wedge, the shoulder extending from the inner surface radially inward of the wedge, the shoulder engageable with the gearbox during installation of the milling rotor to limit contact between the wedge and a drive assembly of the cold planer.

In Example 20, the subject matter of any one or more of Examples 1-19 optionally include wherein a first longitudinal end of the drum is releasably securable to the drive assembly, and wherein the centering ring is located near a second longitudinal end of the drum, opposite the first longitudinal end.

In Example 21, the apparatuses or method of any one or any combination of Examples 1-20 can optionally be configured such that all elements or options recited are available to use or select from.

These and other examples and features of the present devices, systems, and methods will be set forth in part in the following Detailed Description. This overview is intended to provide a summary of subject matter of the present patent application. It is not intended to provide an exclusive or exhaustive removal of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components.

The drawings illustrate generally, by way of example, but not by way of limitation, various embodiments discussed in the present document.

DETAILED DESCRIPTION

In pavement milling applications, such as asphalt milling, different milling drums can be used to attain a variety of surface finishes depending on the requirements of each jobsite or paving material. Because work machines operating the drums are frequently changed, as often as multiple times within a single day, it is important that the assembly and disassembly process of the milling drums be efficient and reliable. The assembly of the milling drum over the inner gearbox coolant tube is an important step in the assembly process to limit damage of the drum and the tube, yet it is desirable to change the drum quickly.

This disclosure helps to address these issues by including an alignment feature on a centering ring connected to an inner part or surface of the milling drum. The alignment feature can engage the inner tube of the gearbox to help align the milling drum into its working position to help improve installation efficiency. Because the alignment feature contacts the tube of the gearbox, the mating surfaces of the centering ring are limited from contacting any components (e.g., the gearbox tube) until the centering ring engages the centering flange. The alignment feature can thereby help to limit damage of the mating surfaces of the centering ring (which can have relatively tight tolerances) during installation. This is especially important because the milling drum must traverse a relatively long path over the gearbox tube as it is inserted into the milling chamber before the centering ring mates with the centering flange, increasing opportunity for damage to the mating surfaces to occur.

Figure 1:
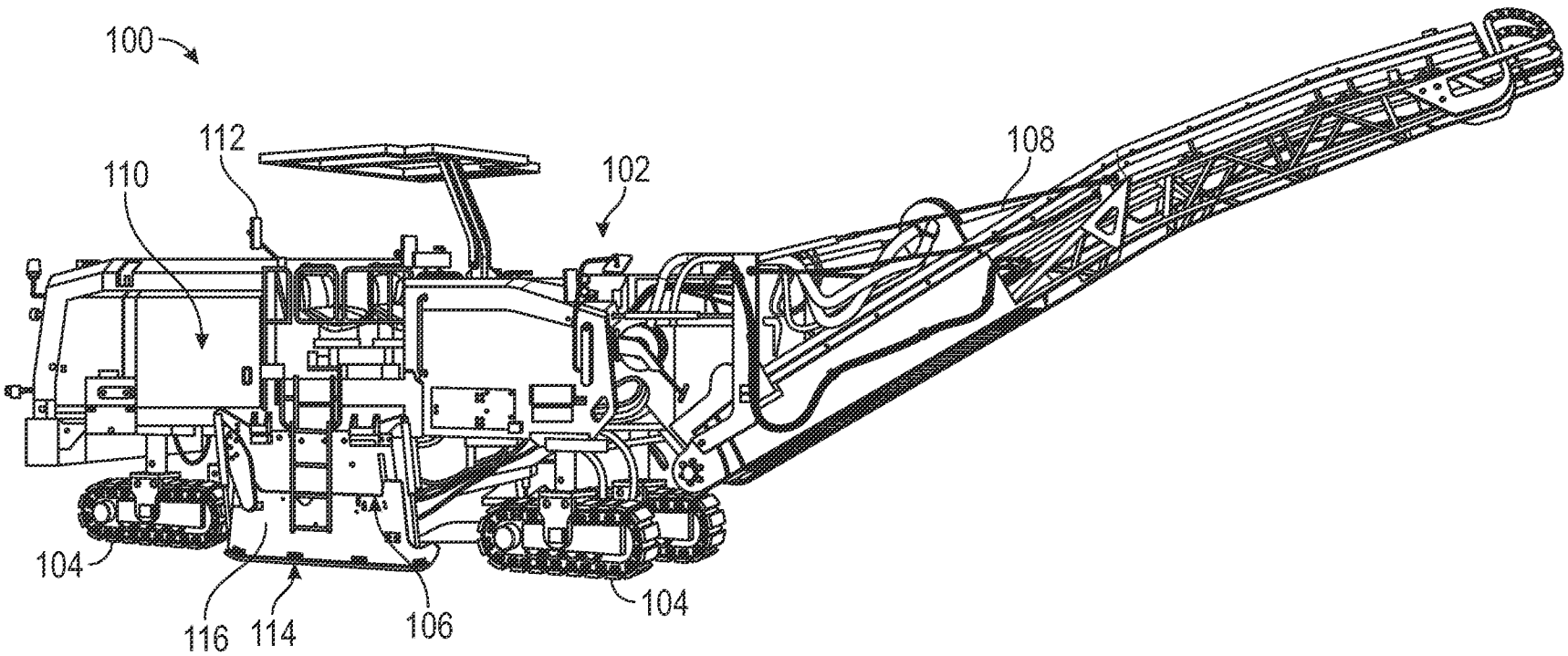
FIG. 1 is a perspective view of a cold planer.

FIG. 1 is a perspective view of a cold planer 100, which can include a body or frame 102, drive tracks 104, a milling system 106, a conveyor 108, a drive system 110, and a cabin 112. The milling system 106 can include a milling chamber 114 and a cover 116.

The body 102 of the cold planer 100 can be a chassis, frame, and exterior panels of the cold planer 100 and can be configured to support and house various components of the cold planer 100 such as the drive tracks 104, the milling system 106, the conveyor 108, the drive system 110, and the cabin 112.

The drive tracks 104 can be connected to the body and can be a set of movable tracks powered by the drive system 110. The drive tracks 104 can be operable by the drive system 110 to move the cold planer 100. The drive system 110 can be a combustion, electric, or other type of motor configured to produce mechanical energy.

The milling system 106 can be a rotary milling system including a drum and a plurality of teeth configured to engage pavement or asphalt for milling thereof. The milling chamber 114 can support a milling drive assembly and drum therein. The cover 116 can substantially enclose the milling rotor. The milling system 106 can also include a sprayer and hydraulic system.

The conveyor 108 can be connected to the body 102 and operably connected to the milling system 106. In operation, the milling system 106 can produce milled material that can be moved to the conveyor 108. The conveyor 108 can move the milled material from the cold planer 100 to a dump truck or other repository.

The cabin 112 can be connected to the body 102 and configured to enclose an operator therein. The cabin 112 can include various controls mounted therein for controlling the operation of, for example, the drive tracks 104, the milling system 106, the conveyor 108, or the drive system 110.

Further details of the milling system 106 are discussed below. Though the milling system 106 is discussed with respect to a standalone cold planer, the components of the milling system 106 could be applied to various work machines, such as a detachable cold planer or any rotary milling machine.

Figure 2:
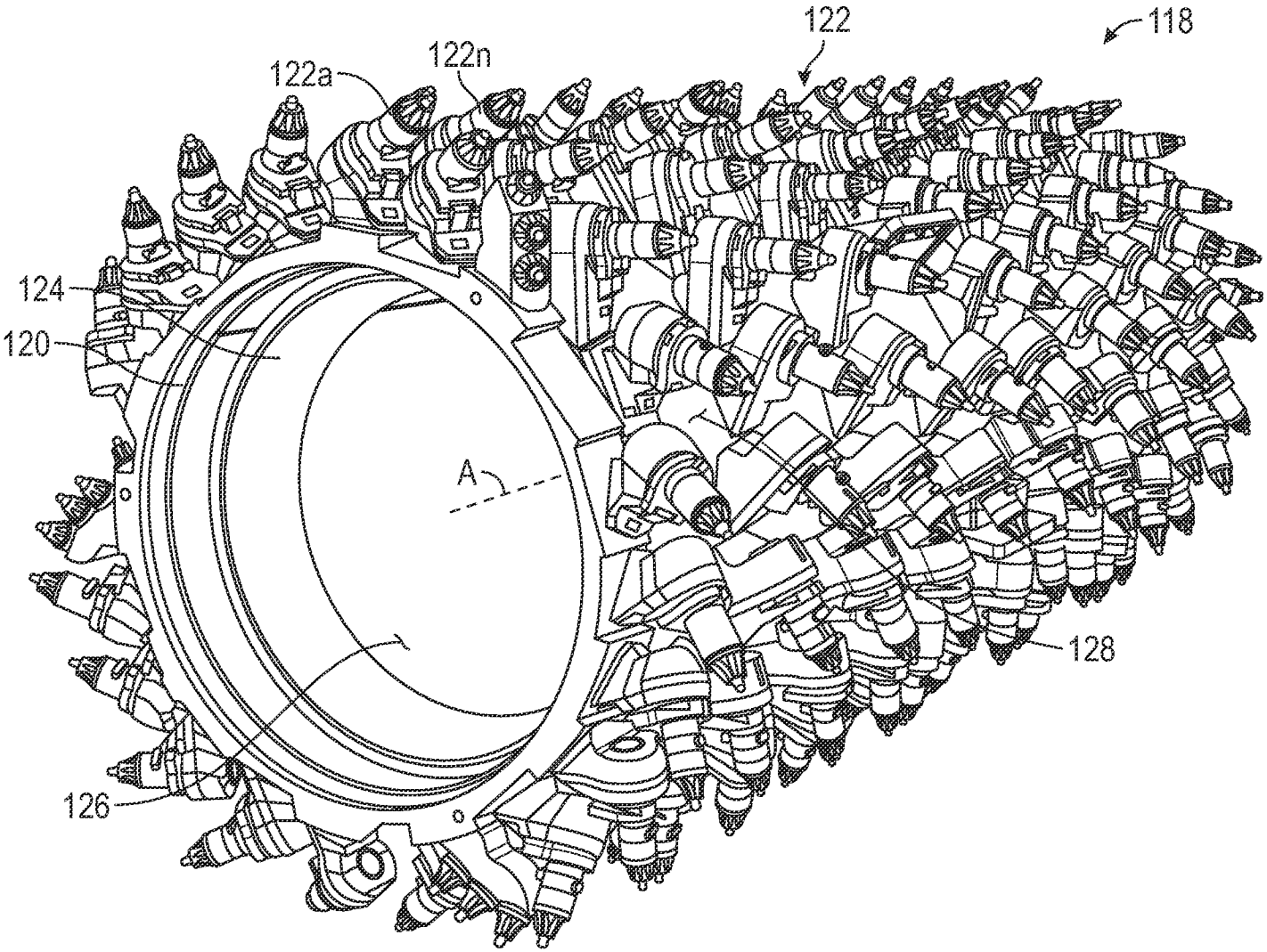
FIG. 2 is an isometric view of a milling rotor for a work machine.

FIG. 2 is an isometric view of a milling rotor 118 for a work machine, such as the cold planer 100. The milling rotor 118 can include a drum 120, cutting teeth 122, and a centering ring 124. The drum 120 can be a rigid or semi-rigid member extending along a longitudinal axis A. The drum 120 can include an inner surface 126 and an opposing outer surface 128. The teeth 122 can be secured (such as releasably securable) to the outer surface of the drum. For example, teeth 122*a* and 122*n* can be secured or securable to the outer surface 128, such as through bit holders or tool holders secured to the drum 120. The centering ring 124 can be secured or securable to the inner surface 126 of the drum 120 and can be engageable with a drive assembly of the milling system 106 to be supported thereby, as discussed in further detail below.

Figure 3:
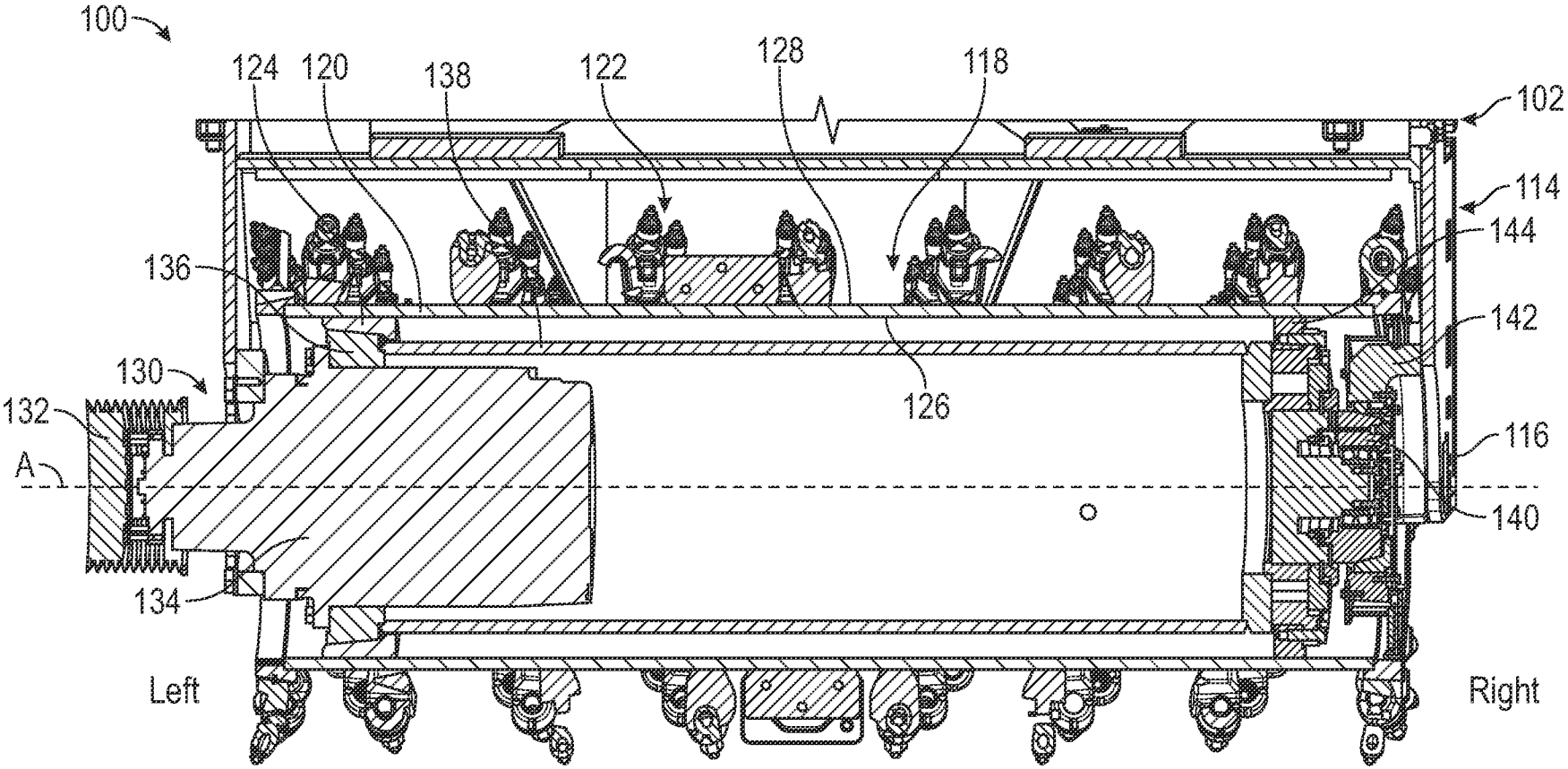
FIG. 3 is a cross-sectional view of a milling rotor in a work machine.

FIG. 3 is a cross-sectional view of a milling rotor 118 of the milling system 106 in the work machine 100. The milling system 106 and the milling rotor 118 of FIG. 3 can be consistent with FIGS. 1 and 2 discussed above. The milling system 106 and the milling rotor 118 are discussed in further detail below.

For example, FIG. 3 shows that the milling rotor 118 can be positioned in the milling chamber 114. More specifically, a drive assembly 130 of the milling system 106 can include a drive pulley 132, gearbox 134, a centering flange 136, an inner tube 138, and a mounting flange 140. The mounting flange 140 can be located on a right side of the milling system 106 and can be releasably securable to a carrying flange 142 of the body 102, such as through a plurality of bolts, to connect the drive assembly 130 to the body 102.

The inner tube 138 can extend along the axis A and can be secured to the mounting flange 140. The centering flange 136 can be secured (e.g., welded or bolted) to the gearbox 134 on a left side (or left end or end portion) of the inner tube 138 and on an outer surface of the inner tube 138. The centering flange 136 can engage the centering ring 124 of the drum 120 to support and center (or locate) the drum 120 and therefore the milling rotor 118 on the left side of the milling chamber 114, opposite the mounting flange 140. The right side or end of the drum 120 can be connected to the inner tube 138 via a drum flange 144 of the drum 120 to secure the drum 120 and therefore the milling rotor 118 to the drive assembly 130, such that the milling rotor 118 can be rotatable with the drive assembly 130.

In operation of some examples, the drive pulley 132 can be driven to rotate by a belt, chain, or the like, such as by the drive system 110 or a component thereof. The drive pulley 132 can drive the gearbox 134 to rotate, rotating the centering flange 136, the inner tube 138, and the mounting flange 140 about the axis A. Such rotation of the drive assembly 130 can drive the drum flange 144 and the drum 120 and therefore the milling rotor 118 (including the teeth 122) to rotate with the drive assembly 130, allowing the milling rotor 118 (e.g., the drum 120) to engage pavement for milling thereof. The milled material can be evacuated from the milling chamber 114 by an evacuation system and removed from the cold planer 100 by the conveyor 108.

At various times during a milling job (or between jobs), the milling rotor 118 is changed, such as to used rotors with different teeth or tooth spacing. During changing of the milling rotor 118, the drum flange 144 can be unbolted (or otherwise disconnected) from the drive assembly 130 (such as the mounting flange 140) and can be removed from the milling chamber 114. Another milling rotor 118 can then be installed and resecured to the drive assembly 130. During installation of the milling rotor 118, the centering ring 124 must pass over the inner tube 138, which can cause damage to the centering ring 124. This is undesirable because the centering ring 124 have a relatively high tolerance bores for centering of the drum 120 with respect to the centering flange 136 and therefore the drive assembly 130 to help ensure proper radial support of the milling rotor 118 and to help balance the milling rotor 118 during rotation thereof. An alignment interface 148 of the centering ring 124 can help to limit engagement between a centering interface 146 of the centering ring 124 with the alignment interface 148, as discussed in further detail below.

Figure 4A:
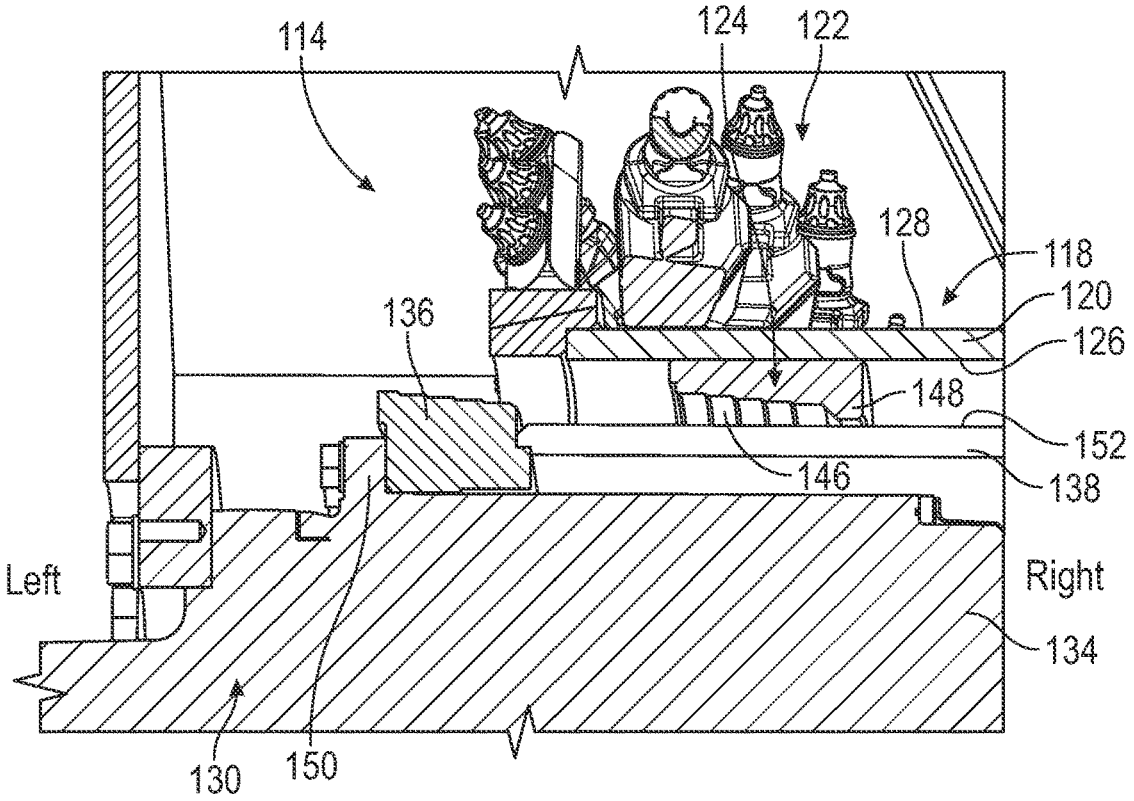
FIG. 4A is an enlarged view of a cross-sectional view of a milling rotor in a work machine in a first condition.
Figure 4B:
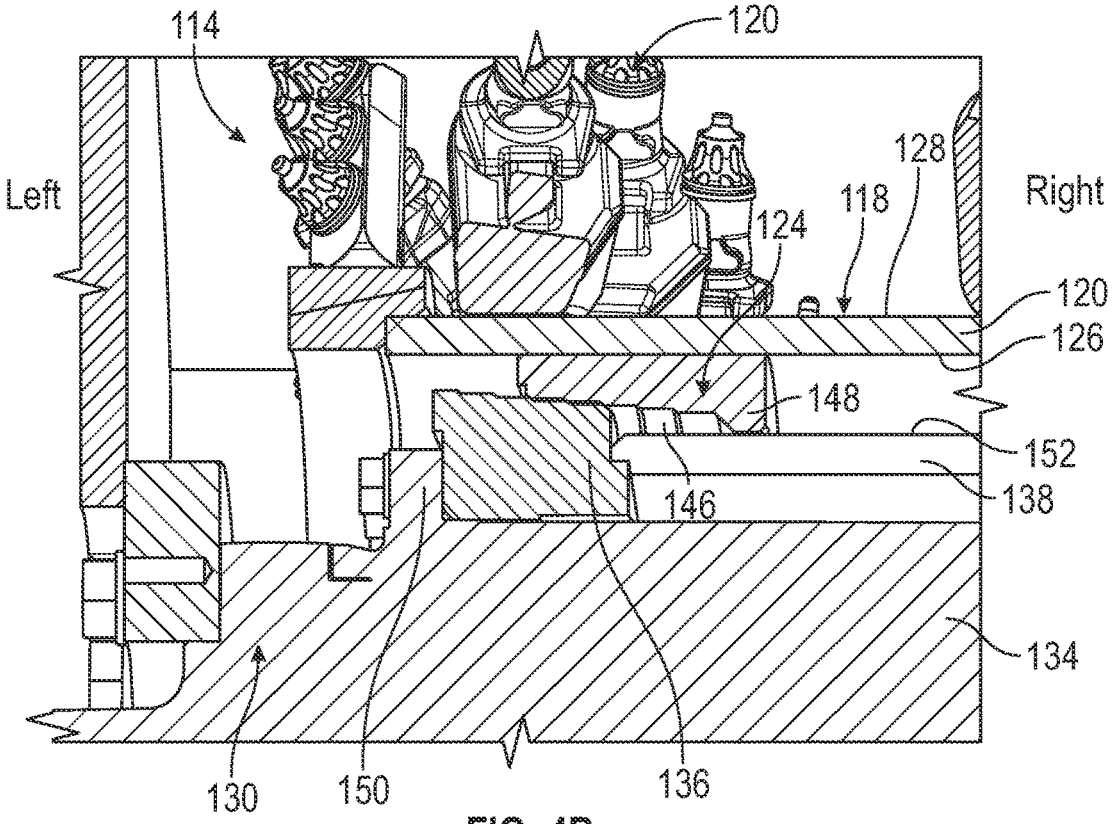
FIG. 4B is an enlarged view of a cross-sectional view of a milling rotor in a work machine in a second condition.
Figure 4C:
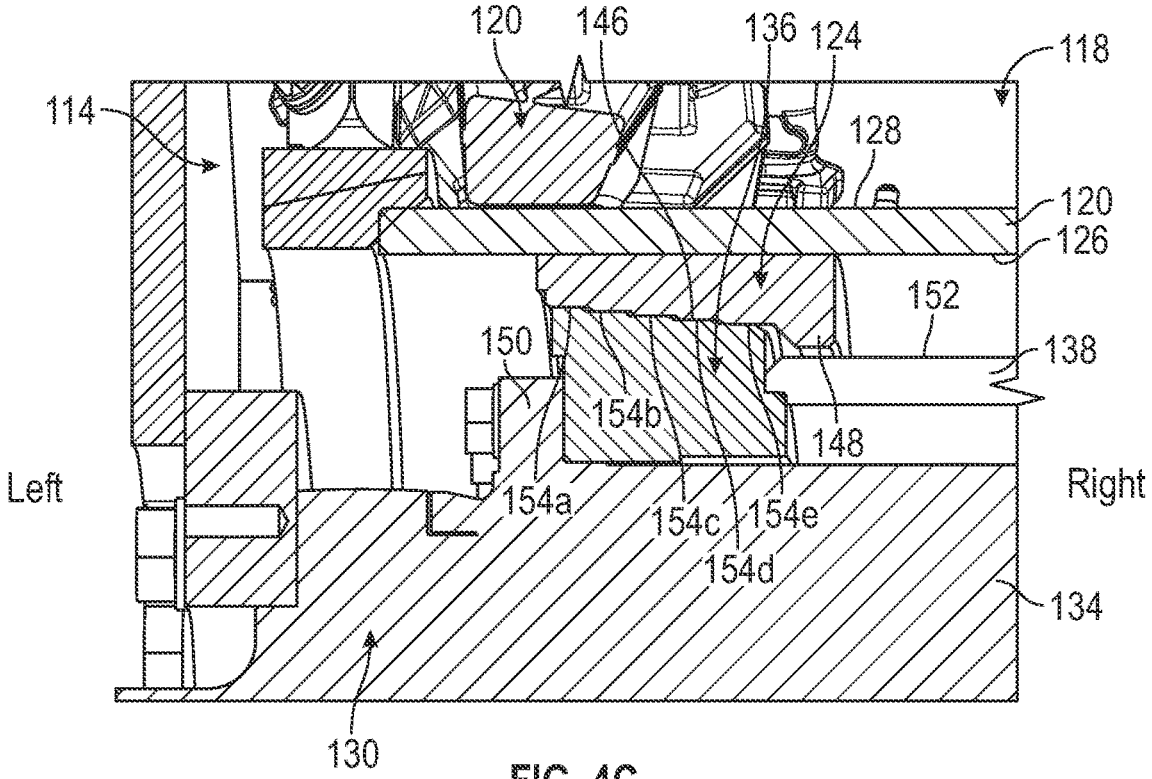
FIG. 4C is an enlarged view of a cross-sectional view of a milling rotor in a work machine in a third condition.

FIG. 4A is an enlarged view of a cross-sectional view of the milling rotor 118 in the work machine 100 in a first stage of installation. FIG. 4B is an enlarged view of a cross-sectional view of the milling rotor 118 in the work machine 100 in a second stage of installation. FIG. 4C is an enlarged view of a cross-sectional view of the milling rotor 118 in the work machine 100 in a third stage of installation. FIGS. 4A-4C are discussed together below. The work machine 100 and the milling rotor 118 can be consistent with FIGS. 1A-3 above; FIGS. 4A-4C show additional details of the cold planer 100 (e.g., the drive assembly 130) and the milling rotor 118.

As shown in FIGS. 4A-4C, the centering flange 136 can be secured to a flange 150 of the centering flange 136 (such as via bolts) to secure the centering flange 136 to an outer surface of the gearbox 134. The inner tube 138 can be secured to the centering flange 136 such as through a bolted or welded interface.

As shown in FIG. 4A, during installation of the milling rotor 118, the alignment interface 148 of the centering ring 124 can engage an outer surface 152 of the inner tube 138 to limit contact between the centering interface 146 and the inner tube 138 as the milling rotor 118 is moved from Right to Left to be fully inserted into the milling chamber 114 and to engage the centering interface 146 with the centering flange 136, which can help limit engagement between a centering interface 146 of the centering ring 124 with the alignment interface 148, helping to protect the surfaces of the centering interface 146.

As shown in FIG. 4B, the alignment interface 148 can be configured (e.g., sized or shaped) to position or locate the centering interface 146 on the centering flange 136 as the milling rotor 118 is translated from left to right. Then, as shown in FIG. 4C, the milling rotor 118 can be moved further left to position the centering interface 146 entirely on centering faces 154*a*-154*e* of the centering flange 136. When this occurs, the alignment interface 148 can be lifted off the outer surface 152 of the inner tube 138 such that the alignment interface 148 is radially spaced away from the tube 138. Though five of the centering faces 154*a*-154*e* are shown and discussed, the centering flange 136 can include 1, 2, 3, 4, 6, 7, 8, 9, 10, or the like centering bores.

In operation of some examples, the alignment interface 148 can be engaged with the inner tube 138 of the drive assembly 130 to limit contact between the centering interface 146 and the drive assembly 130. Then, the milling rotor 118 can be translated into the milling chamber 114 relative to the drive assembly 130, such as along the axis A. The milling rotor centering interface 146 can engage the centering flange 136 to center, locate, or position the centering ring 124, the drum 120, and therefore the milling rotor 118 with respect to the centering flange 136 and the drive assembly 130. When the centering interface 146 fully engaged the centering flange 136, the alignment interface 148 can be spaced radially away from the inner tube 138. Thereafter, the milling rotor 118 can be secured to the mounting flange 140 to secure the milling rotor 118 to the body 102.

Figure 5A:
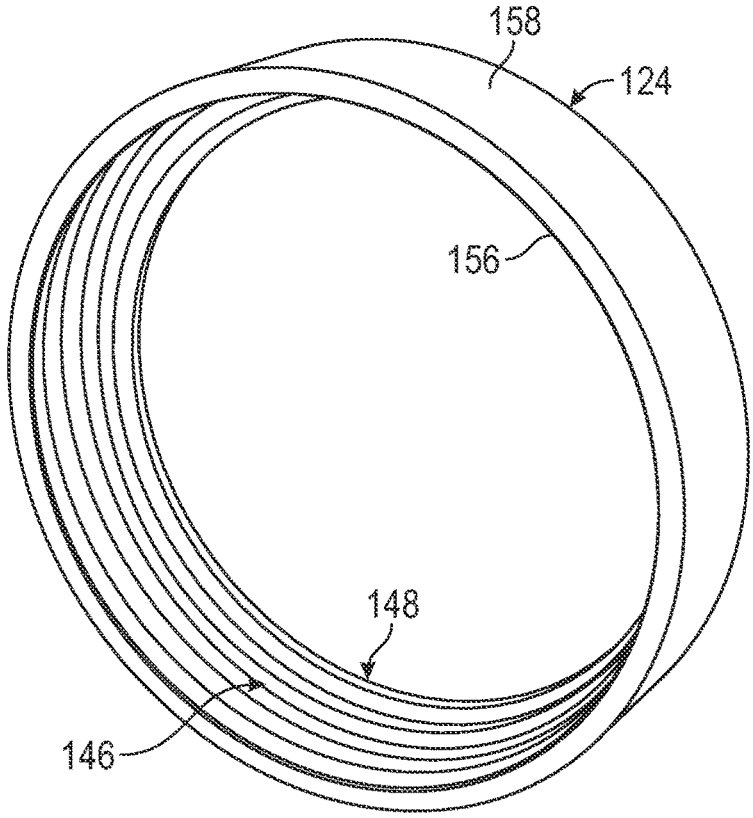
FIG. 5A is an isometric view of a centering ring for a drum for a work machine.
Figure 5B:
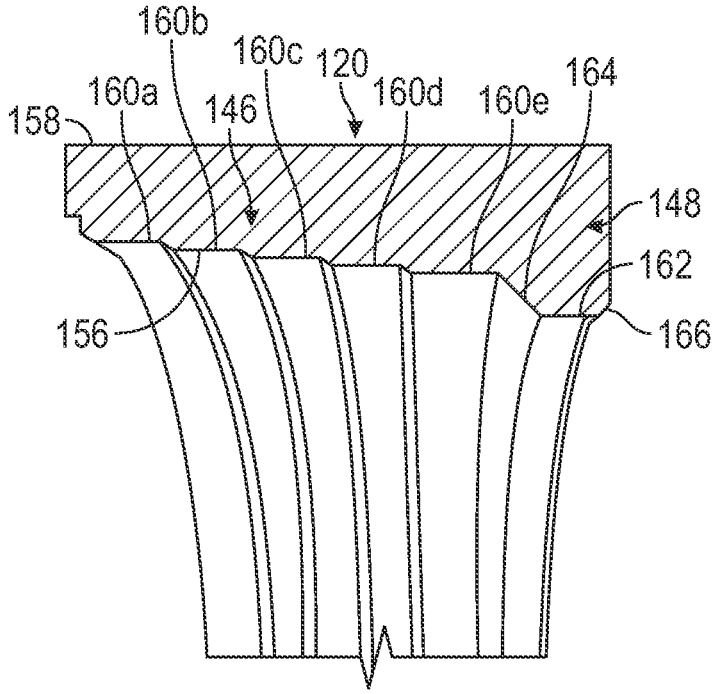
FIG. 5B is a cross-sectional view of a centering ring for a drum for a work machine.

FIG. 5A is an isometric view of the centering ring 124 of the drum 120 of the work machine 100. FIG. 5B is a cross-sectional view of the centering ring 124 of the drum 120 of the work machine 100. FIGS. 5A and 5B are discussed together below. The centering ring 124 can be consistent with FIGS. 1A-4C above; FIGS. 5A and 5B show additional details of the centering ring 124.

For example, FIG. 5A shows that the centering ring 124 can be annular or circular and can include the centering interface 146 and the alignment interface 148 adjacent each other and on an inner portion 156 of the centering ring 124. An opposing outer portion 158 can be secured to the drum 120, as shown in FIGS. 4A-4C.

FIG. 5B shows that the centering interface 146 extend or face radially inward and can be or can act as a wedge. The centering interface 146 can include a plurality of centering bores 160*a*-160*e* (or stepped bores). Each of the centering bores 160*a*-160*e* can be engageable with the centering faces 154*a*-154*e*, respectively, of the centering flange 136 such that the centering flange 136 can accurately center and locate the centering ring 124 and therefore the drum 120 and the milling rotor 118 with respect to the drive assembly 130. Though five of the centering bores 160*a*-160*e* are shown and discussed, the centering interface 146 can include 1, 2, 3, 4, 6, 7, 8, 9, 10, or the like centering bores.

FIG. 5B also shows that the alignment interface 148 can extend or face radially inward and can be or can act as a shoulder with respect to the centering interface 146. The centering interface 146 can be adjacent to the alignment interface 148 and the alignment interface 148 can include an alignment face 162. The alignment face 162 can be diametrically smaller than the diameters of centering bores 160*a*-160*e*. The alignment face 162 can also be configured (e.g., sized or shaped) such that when the alignment interface 148 engages the centering flange 136, the alignment interface 162 engages the inner tube 138 to position the centering bores 160*a*-160*e* with respect to the centering flange 136 such that the centering bores 160*a*-160*e* only need to move or climb two diameters of the centering faces 154*a*-154*e* to correctly position the centering ring 124 on the centering flange 136.

The alignment face 162 can be flat (or planar) or curved (or arced) and configured (e.g., sized or shaped) to engage the opposing inner tube 138. The alignment interface 148 can also include a first chamfer 164 that can be connected to the alignment face 162 and to one of the centering bores 160 (e.g., the centering bore 160*e*). The alignment interface 148 can also include a second chamfer 166 that can extend from the alignment face 162 to an end of the centering ring. The first chamfer 164 and the second chamfer 166 can help to ensure that the alignment face 162 engages the inner tube 138 during installation of the milling rotor 118.

The centering ring 124 can optionally be made of steel as can the inner tube 138 and the centering flange 136. Optionally, the alignment interface 148 can be made of low friction materials, such as one or more polymers, such as nylon or Polytetrafluoroethylene. The alignment interface 148 can act as a sacrificial interface, helping to limit damage of the centering interface 146. Because this can make the alignment interface 148 a wear component, the centering ring 124 can optionally be releasably securable to the drum 120, such as through bolts or other fasteners, allowing the centering ring 124 to be replaced when the alignment interface 148 wears down.

Figure 6:
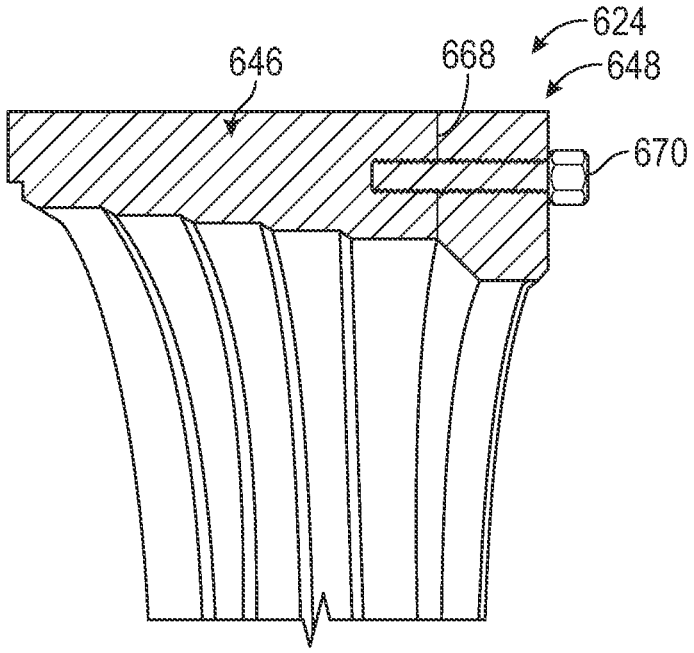
FIG. 6 is a cross-sectional view of a centering ring for a drum for a work machine.

FIG. 6 is a cross-sectional view of a centering ring 624 for a drum (e.g., the drum 120) of a work machine (e.g., the work machine 100). The centering ring 624 can be similar to the centering ring 124, the centering ring 624 can differ in that it can include an alignment interface that is releasably securable to a centering interface. Any of the previously discussed centering rings can be modified to includes such an alignment interface.

More specifically, the centering ring 624 can include a centering interface 646 and an alignment interface 648. Similar to the centering interface 146 and the alignment interface 148, the centering interface 646 can be configured to engage a centering flange (e.g., the centering flange 136) to support and center the rotor of the centering ring 624. Also, the alignment interface 648 can be engageable with a tube of a drive assembly (such as the inner tube 138 of the drive assembly 130) during installation of the rotor. Also, the alignment interface 648 can be separate and engaged with the centering interface 646 at a mounting surface 668, where the alignment interface 648 can be releasably securable to the centering interface 646 using one or more fasteners 670, which can be screws, bolts, rivets, or the like.

As discussed briefly above, because the alignment interface 648 can act as a sacrificial interface, helping to limit damage of the centering interface 646, the alignment interface 648 can be a wear component. However, because the alignment interface 648 can be removed from the centering interface 646, when the alignment interface 648 wears down, a new alignment interface 648 can be installed (secured) to the centering interface 646, making the alignment interface 648 replaceable, helping to protect the centering interface 646.

In the foregoing Detailed Description, it can be seen that various features are grouped together in a single example for the purpose of streamlining the disclosure. This method of disclosure is not to be interpreted as reflecting an intention that the claimed examples require more features than are expressly recited in each claim. Rather, as the following claims reflect, inventive subject matter lies in less than all features of a single disclosed example. Thus, the following claims are hereby incorporated into the Detailed Description, with each claim standing on its own as a separate example.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific examples. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific examples. However, the benefits, advantages, solutions to problems, and any feature(s) that may cause any benefit, advantage, or solution to occur or become more pronounced are not to be construed as a critical, required, or essential feature of any or all the claims. Moreover, the particular examples disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular examples disclosed above may be altered or modified and all such variations are considered within the scope of the disclosed subject matter. Accordingly, the protection sought herein is as set forth in the claims below.

INDUSTRIAL APPLICABILITY

The disclosed milling rotor and centering ring can be applied to any rotating drum or component of any milling machine or work machine. The disclosed centering ring and alignment interface can help reduce time and labor during installation of a milling rotor. By limiting contact between the centering interface of the centering ring with a tube (or other components) of the drive assembly for the milling assembly, damage to the centering interface of the centering ring of the milling rotor can also be limited. This can be especially important because the centering interface can have one or more surfaces with relatively tight tolerances for engagement with the centering flange of the drive assembly. The alignment assembly can thereby help to improve balance and efficiency of operation of the milling rotor. These components can be applied to various work machines having rotating components to achieve similar benefits.

What is claimed is:

1. A milling assembly of a work machine, the assembly comprising:

a drive assembly connected to a body of the work machine and drivable to rotate about a longitudinal axis by a motor of the work machine, the drive assembly including a centering flange on an outer surface thereof; and a milling rotor releasably securable to the drive assembly, the milling rotor comprising:

a drum extending along the longitudinal axis, the drum defining an inner surface and an opposing outer surface, the drum securable to the drive assembly to allow the drum to rotate therewith;

a plurality of cutting teeth connected to the outer surface of the drum and configured to engage pavement; and a centering ring connected to the inner surface of the drum, the centering ring comprising:

a centering interface facing radially inward and engageable with the centering flange to center the milling rotor with respect to the drive assembly; and an alignment interface adjacent the centering interface and extending radially inward of the centering interface, the alignment interface engageable with the drive assembly to limit contact between the centering interface and the drive assembly during installation thereof, wherein the drive assembly includes a tube extending along the longitudinal axis, the centering flange connected to the tube, and the alignment interface engageable with the tube during installation of the rotor, and wherein the alignment interface is radially spaced away from the centering tube when the centering interface is engaged with the centering flange.

2. The milling assembly of claim 1, wherein a first longitudinal end of the drum is releasably securable to the drive assembly.

3. The milling assembly of claim 2, wherein the centering ring is located near a second longitudinal end of the drum, opposite the first longitudinal end.

4. The milling assembly of claim 1, wherein the centering interface includes a plurality of centering bores engageable with a plurality of centering faces of the centering flange.

5. The milling assembly of claim 4, wherein the plurality of centering bores includes five bores.

6. The milling assembly of claim 4, wherein the alignment interface includes a first chamfer connecting the alignment interface to the plurality of centering bores and a second chamfer extending to an end of the centering ring.

7. The milling assembly of claim 4, wherein the alignment interface is releasably securable to the centering interface.

8. The milling assembly of claim 1, wherein a first longitudinal end of the drum is releasably securable to the drive assembly, and wherein the centering ring is located near a second longitudinal end of the drum, opposite the first longitudinal end.

9. A milling rotor of a milling machine, the milling rotor comprising:

a drum extending along a longitudinal axis and defining an inner surface and an opposing outer surface, the drum securable to a drive assembly of the milling machine to allow the drum to rotate therewith;

a plurality of cutting teeth connected to the outer surface of the drum and configured to engage pavement; and a centering ring connected to the inner surface of the drum, the centering ring comprising:

a centering interface extending radially inward from the inner surface and engageable with a centering flange of the drive assembly to center the milling rotor with respect to the drive assembly; and an alignment interface adjacent the centering interface and extending from the inner surface radially inward of the centering interface, the alignment interface engageable with the drive assembly to limit contact between the centering interface and the drive assembly during installation thereof, wherein the drive assembly includes a tube extending along the longitudinal axis, the centering flange connected to the tube, and the alignment interface engageable with the tube during installation of the rotor, wherein the alignment interface is radially spaced away from the tube when the centering interface is engaged with the centering flange, wherein the centering interface includes a plurality of centering bores engageable with a plurality of centering faces of the centering flange, and wherein the alignment interface includes a first chamfer connecting the alignment interface to the plurality of centering bores and a second chamfer extending to an end of the centering ring.

10. The milling rotor of claim 9, wherein a first longitudinal end of the drum is releasably securable to the drive assembly.

11. The milling rotor of claim 10, wherein the centering ring is located near a second longitudinal end of the drum, opposite the first longitudinal end.

12. The milling rotor of claim 9, wherein the plurality of centering bores includes five bores.

13. The milling rotor of claim 9, wherein the alignment interface is releasably securable to the centering interface.

* * * * *